US007121764B2

(12) United States Patent
Rørheim

(10) Patent No.: US 7,121,764 B2
(45) Date of Patent: Oct. 17, 2006

(54) PORTABLE FLOOD BARRIER SECTION AND FLOOD BARRIER

(76) Inventor: Thor Olav Rørheim, Flåtavikveien 11, Engalsvik (NO) N-1628

( * ) Notice: Subject to any disclaimer, the term of this patent is extended or adjusted under 35 U.S.C. 154(b) by 0 days.

(21) Appl. No.: 10/471,255

(22) PCT Filed: Mar. 13, 2002

(86) PCT No.: PCT/NO02/00103

§ 371 (c)(1),
(2), (4) Date: Dec. 8, 2003

(87) PCT Pub. No.: WO02/075057

PCT Pub. Date: Sep. 26, 2002

(65) Prior Publication Data

US 2004/0096275 A1 May 20, 2004

(30) Foreign Application Priority Data

Mar. 16, 2001 (NO) ..... 20011369

(51) Int. Cl.
*E02B 7/00* (2006.01)

(52) U.S. Cl. ..... 405/107; 405/100; 405/113; 405/115

(58) Field of Classification Search ..... 405/107, 405/100, 113–117, 87, 99
See application file for complete search history.

(56) References Cited

U.S. PATENT DOCUMENTS

| | | | | | |
|---|---|---|---|---|---|
| 2,128,657 | A * | 8/1938 | Madaras | 405/113 |
| 4,582,451 | A * | 4/1986 | Hollander, Jr. | 405/105 |
| 4,682,443 | A * | 7/1987 | Demo | 49/466 |
| 5,118,217 | A * | 6/1992 | Younes | 405/114 |
| 6,196,764 | B1 * | 3/2001 | Bayssiguier | 405/102 |
| 6,413,014 | B1 * | 7/2002 | Melin | 405/107 |
| 6,450,733 | B1 * | 9/2002 | Krill et al. | 405/114 |
| 6,623,209 | B1 * | 9/2003 | Waters, Jr. | 405/94 |
| 2003/0190193 | A1 * | 10/2003 | Waters, Jr. | 405/110 |

FOREIGN PATENT DOCUMENTS

| | | | | |
|---|---|---|---|---|
| DE | 19807640 | | 9/1998 | |
| FR | 2570728 | * | 8/1986 | 405/100 |
| WO | WO 98/51865 | | 11/1998 | |
| WO | WO 99/49143 | | 9/1999 | |

* cited by examiner

*Primary Examiner*—Frederick L. Lagman
(74) *Attorney, Agent, or Firm*—Christian D. Abel

(57) ABSTRACT

A portable flood barrier section is located on a ground (2) to form a barrier (3) against flooding water (4), comprising an erectable wall (5) which along one of its edges (6) is hinged to a basis. The hinge (7) enables a rotating erection (A) of the wall (5) from an essentially horizontal position to an erected position. A flexible or rigid tie (8, 9), which extends from the basis to the wall (5) on the flooded side (10) of the wall (5), prevents an erection of the wall (5) beyond the erected position. A seal (12) is in the erected position of the flood barrier section (1) located between the flood barrier section and the ground (2). The flood barrier section (1) is adapted to, prior to flooding, to expose the seal (12) to a positive sealing pressure exceeding a pressure caused by the weight of the flood barrier section (1). The invention also relates to a flood barrier (3) comprising flood barrier sections (1).

14 Claims, 6 Drawing Sheets

PORTABLE FLOOD BARRIER SECTION AND FLOOD BARRIER

Figure 2:
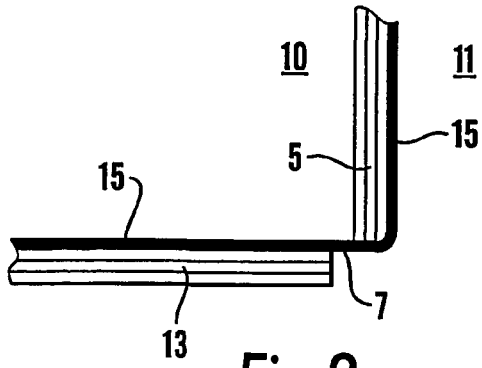

The invention relates to a portable flood barrier section to be located on a ground to form a barrier against flooding water, comprising an erectable wall which along one of its edges is hinged to a basis, the hinge enabling a rotating erection of the wall from an essentially horizontal position to an erected position, and a flexible or rigid tie which extends from the basis to the wall on the flooded side of the wall, to prevent an erection of the wall beyond the erected position.

The invention also relates to a flood barrier comprising flood barrier sections.

Flooding, caused by melted snow, storms or heavy rain, each year cause great damage and sometimes personal injury. Various types of barricades are used as flood barriers. An example of a barricade is the sandbag barricade. This barricade is, however, slow to build, and the building require a lot of labour.

Flood barriers which can be erected more quickly are known. GB 1 562 022 describes a flood barrier section or barrage which is permanently attached to a basis formed by a threshold structure on the bottom of a waterway to be dammed, the threshold structure being provided with a hollow recess to receive the barrage. The barrage comprises a wall or flap which along one of its edges is hinged to the threshold structure, the hinge enabling a rotating erection of the wall from an essentially horizontal position to an erected position, in order to form a barrier against flooding water. A tie which extends from the threshold structure to the wall on the flooded side of the wall prevents an erection of the wall beyond the erected position.

A drawback of the flood barrier according to GB 1 562 022 is that both the threshold structure and the various elements of the barrier are exposed to the environment when not in use. Such exposure to humidity, and possibly frost or heat, will after some years normally cause corrosion and malfunctioning. Further, the location of the flood barrier is restricted to the location of the threshold structure.

Portable flood barriers, which can be stored under controlled conditions when not in use, are also known. SE 507 121 describes portable flood barrier sections to be located on a ground to form a barrier against flooding water, comprising a vertical wall which along its lower edge is attached to a support plate. A tie which extends from the support plate to the wall on the flooded side of the wall prevents the wall from yielding to the pressure of the flooding water. In a collapsible embodiment the wall and the support plate can be separated, and the support plate has a groove for fixing the wall. A flexible waterproof sheet prevents leakage through the connection between the wall and the support plate.

A drawback of the flood barrier according to SE 507 121 is that water may leak underneath the support plate. Further, in the collapsible embodiment, the connection between the wall and the support plate will easily loosen.

The object of the invention is to provide a portable flood barrier section and a portable flood barrier for which water leakage underneath the flood barrier section or the flood barrier and the ground is prevented or is only small. A further object is that the portable flood barrier section preferably shall be collapsible, in order to enable compact storing when not in use.

The objects are achieved by a portable flood barrier section according to claim 1 and a flood barrier according to claim 12.

The invention thus relates to a portable flood barrier section to be located on a ground to form a barrier against flooding water, comprising an erectable wall which along one of its edges is hinged to a basis, the hinge enabling a rotating erection of the wall from an essentially horizontal position to an erected position, and a flexible or rigid tie which extends from the basis to the wall on the flooded side of the wall, to prevent an erection of the wall beyond the erected position. The portable flood barrier section is provided with a seal which in the erected position of the flood barrier section is located between the flood barrier section and the ground. The flood barrier section is adapted to, prior to flooding, to expose the seal to a positive sealing pressure exceeding a pressure caused by the weight of the flood barrier section. It is thereby provided a portable flood barrier section for which water leakage underneath the flood barrier section and the ground is prevented or is only small. The hinge between the wall and the basis makes the portable flood barrier section collapsible.

The portable flood barrier section according to the invention can be realised in various embodiments.

In one embodiment of the portable flood barrier section the basis is formed by a support plate which is located on the flooded side of the wall. In this embodiment the seal may be located under the support plate.

In another embodiment the basis is formed by a permanent foundation in the ground. In both this embodiment and the embodiment in which the basis is formed by a support plate, the wall may be provided with a projecting seal flange extending along the hinged edge of the wall, and the seal may be located under the seal flange.

In addition to the positive sealing pressure from the flood barrier section according to the invention, the seal is during the flooding exposed to a sealing pressure which is caused by the pressure of the flooding water. An increasing water height, which will cause an increasing tendency to water leakage underneath the flood barrier section, also causes an increasing pressure on the flood barrier section, which in turn causes an increasing sealing pressure.

The invention also relates to a flood barrier comprising flood barrier sections according to the invention. In this flood barrier, the flood barrier sections are mutually joined in the longitudinal direction of the flood barrier by waterproof second seals.

Figure 1:
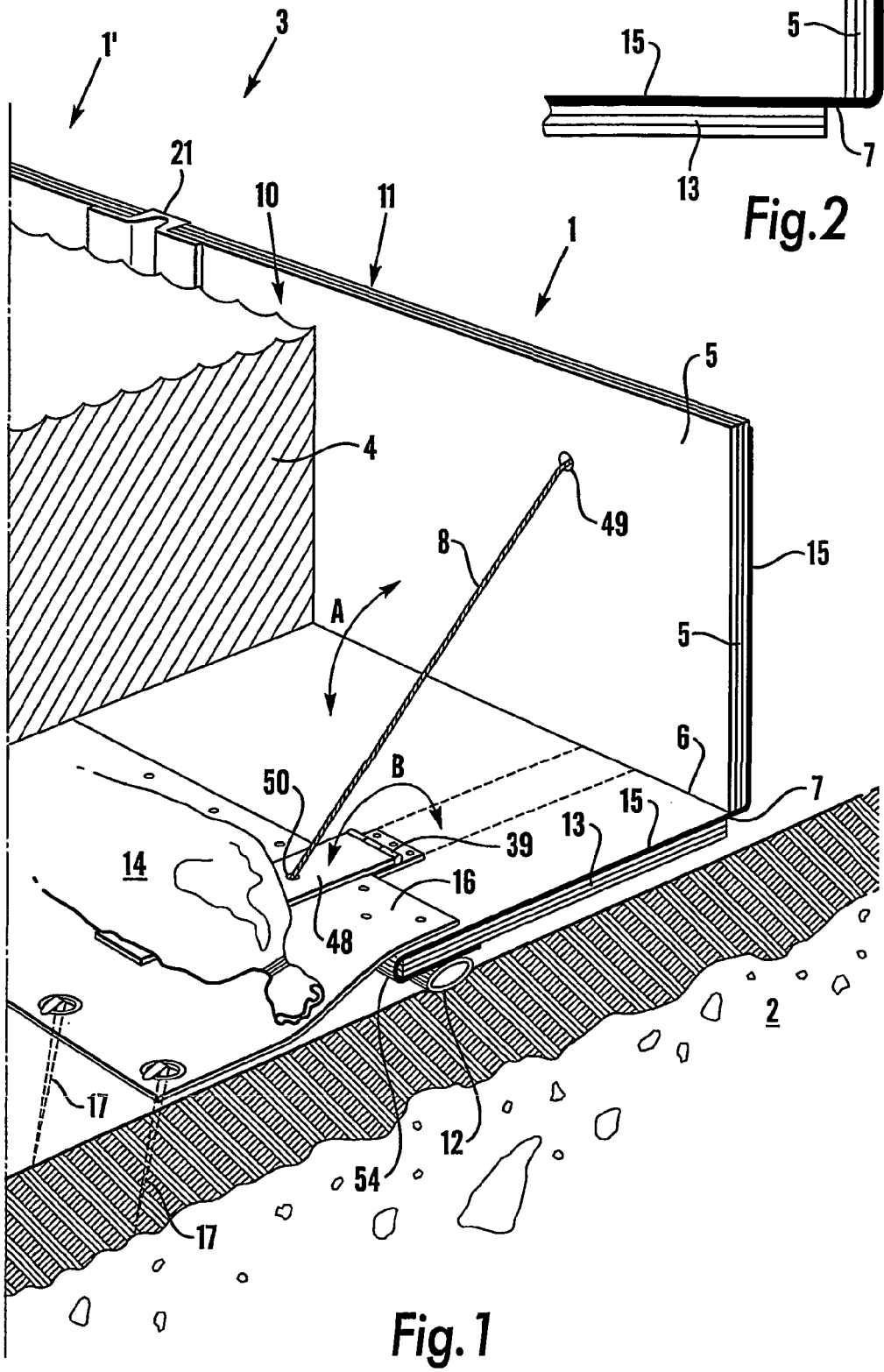
Figure 3:
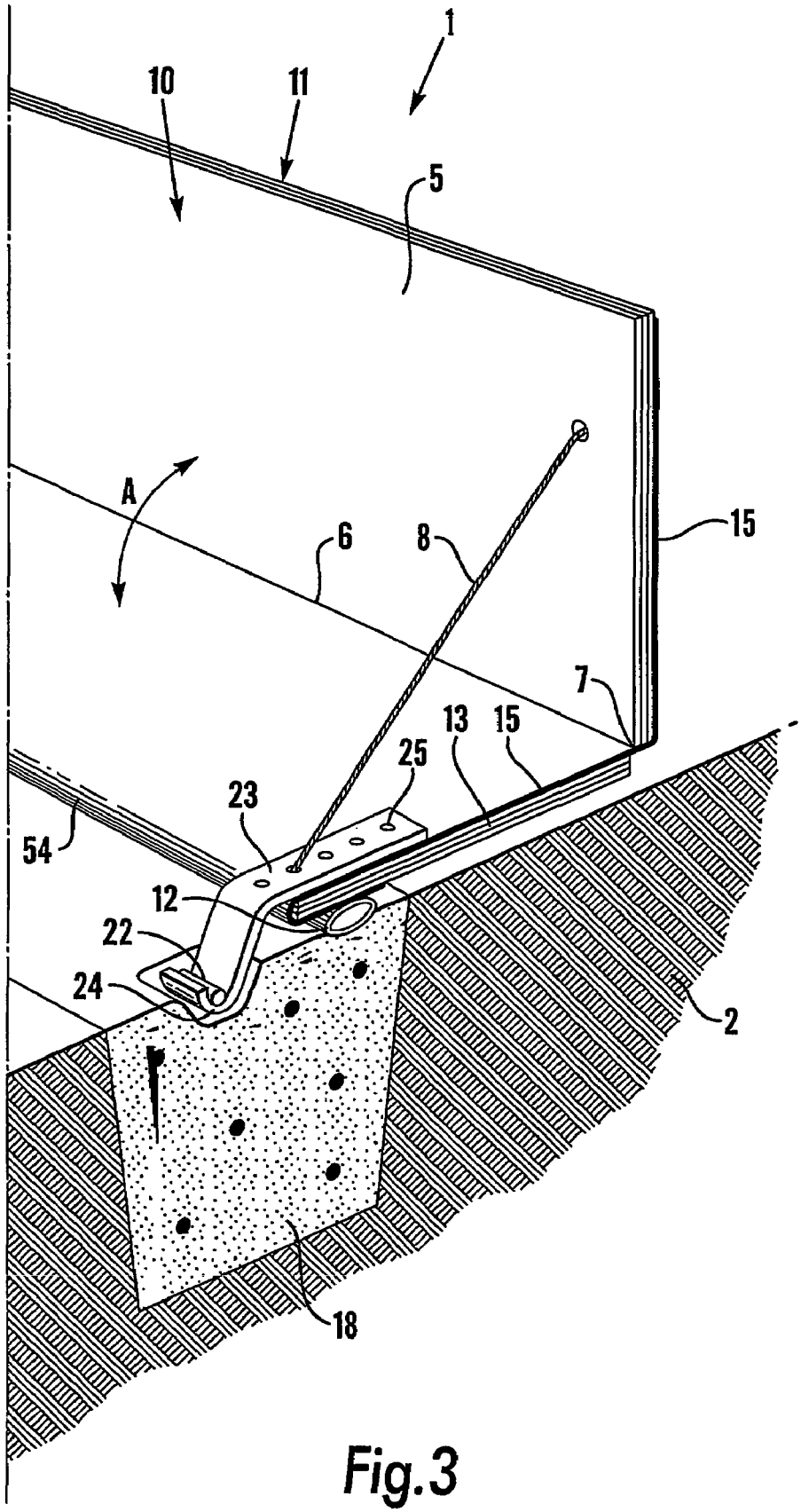
Figure 4:
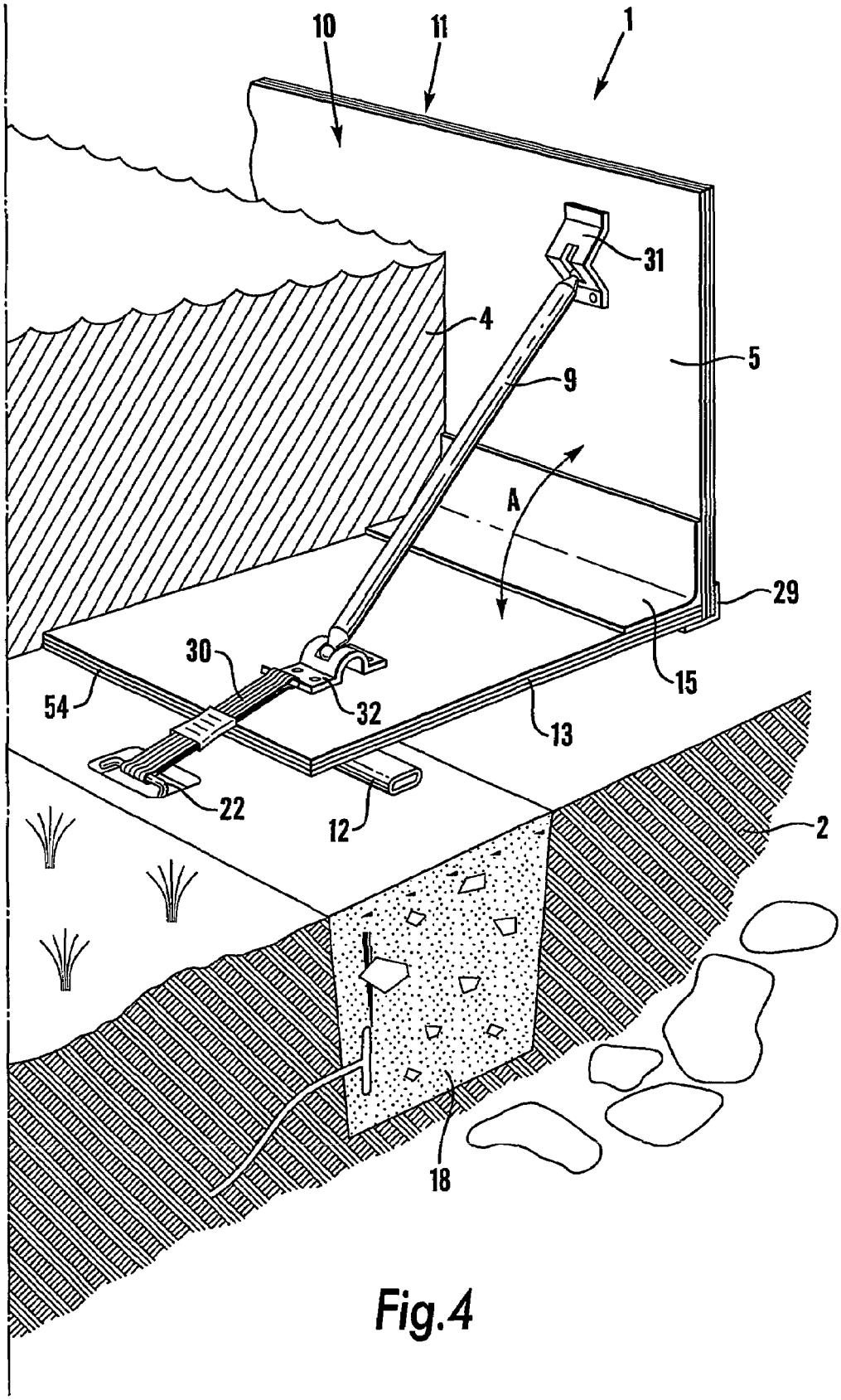
Figure 5:
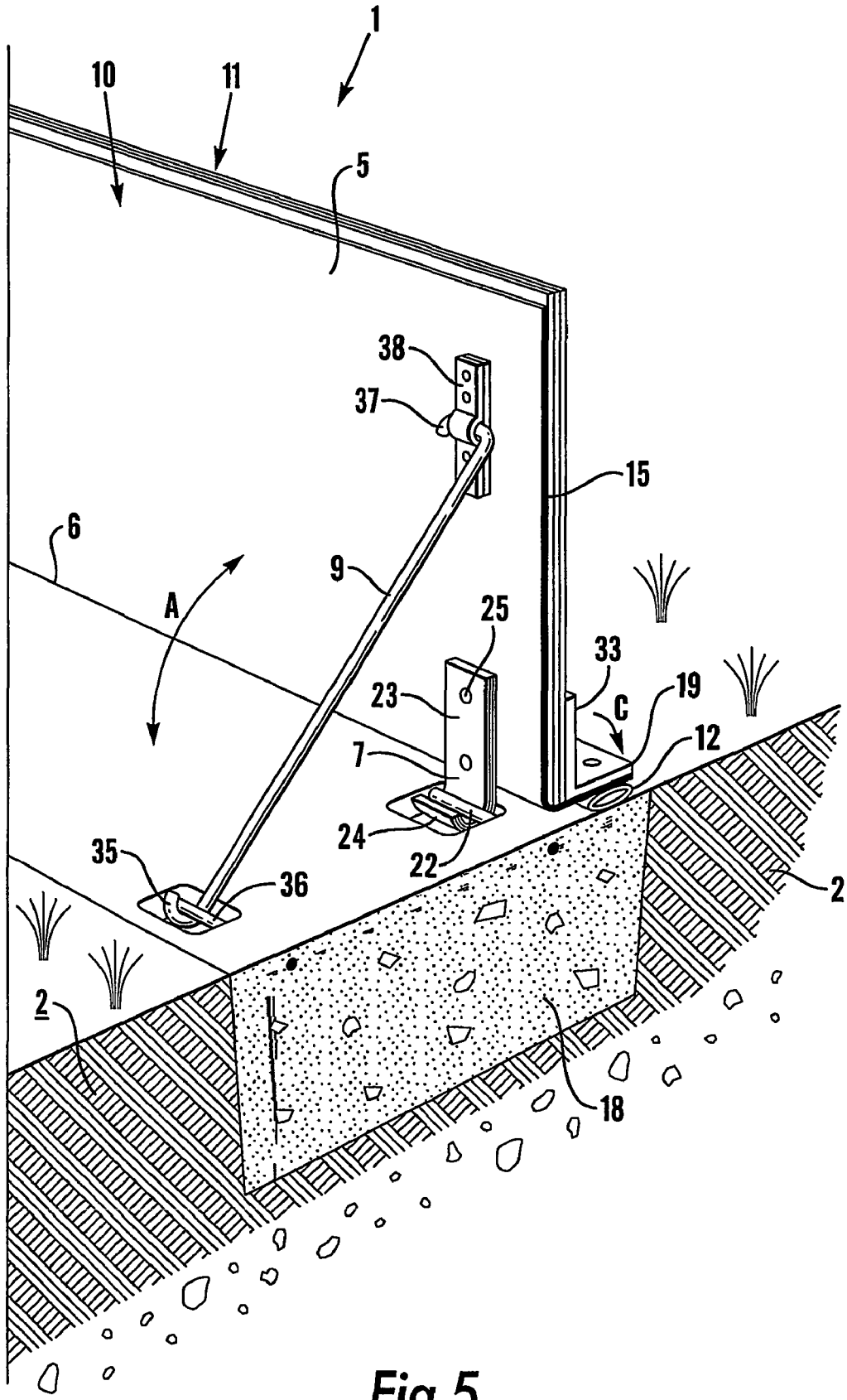
Figure 6:
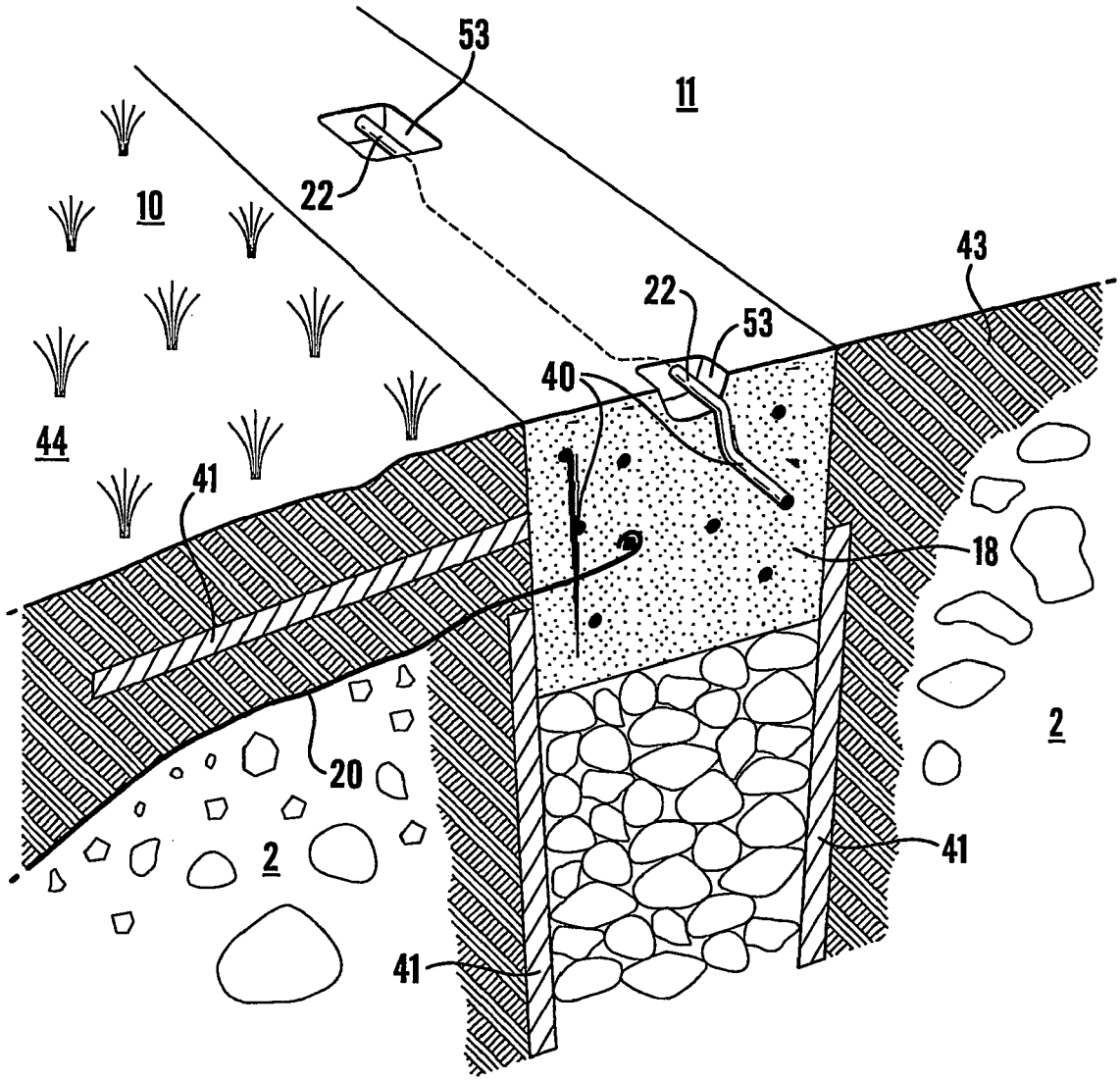
Figure 7:
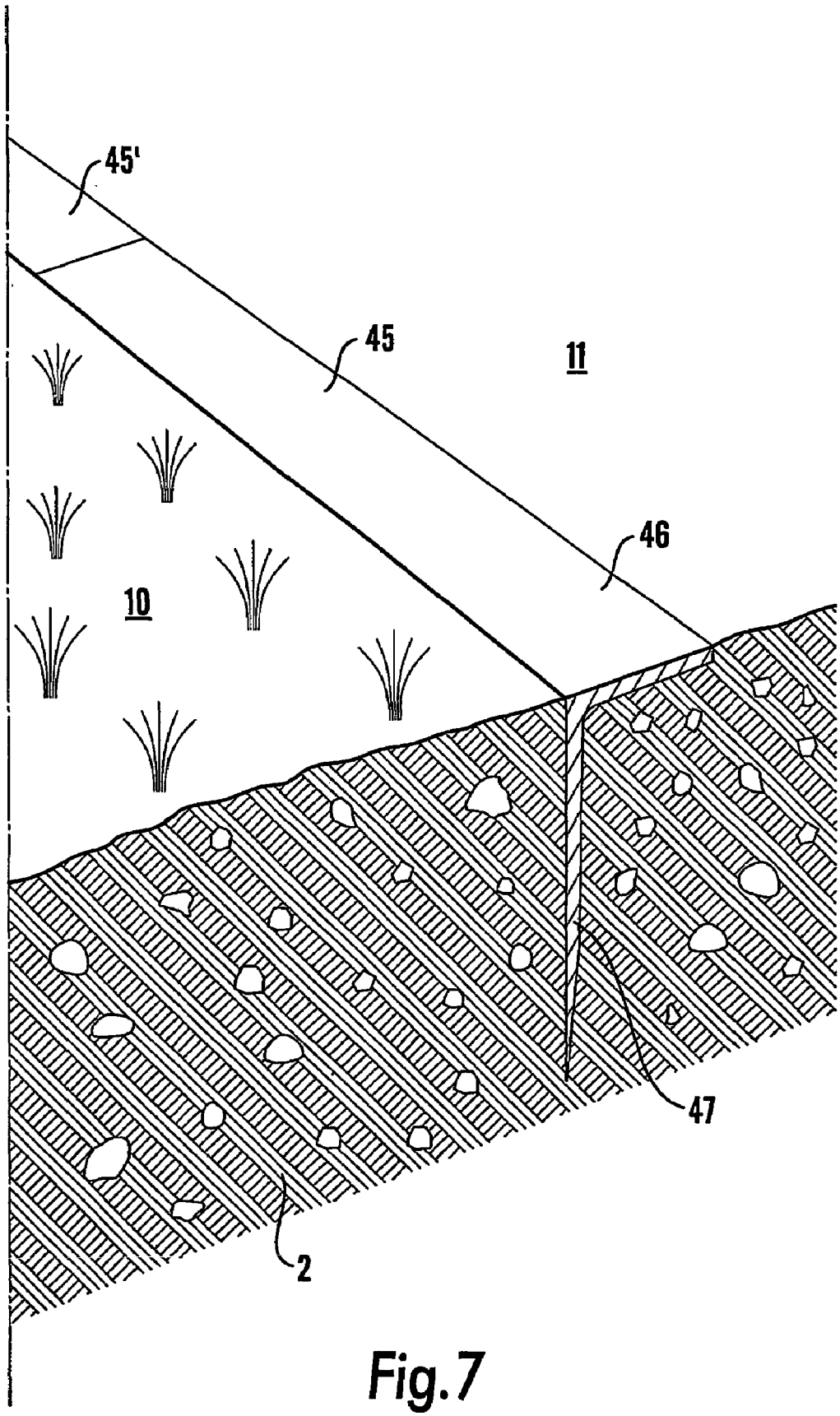

Further objects and embodiments of the invention will appear from the detailed part of the description and the drawings, in which:

FIG. 1 illustrates a first embodiment of a portable flood barrier section and a flood barrier according to the invention, FIG. 2 illustrates a detail from FIG. 1, FIG. 3 illustrates a second embodiment of a portable flood barrier section according to the invention, FIG. 4 illustrates a third embodiment of a portable flood barrier section according to the invention, FIG. 5 illustrates a fourth embodiment of a portable flood barrier section according to the invention, FIG. 6 illustrates a foundation to be used with the invention, and FIG. 7 illustrates another foundation to be used with the invention.

FIG. 1 illustrates a first embodiment of a portable flood barrier section 1 according to the invention. The flood barrier section 1 is located on a ground 2, and together with an adjoining flood barrier section 1' and other not illustrated flood barrier sections, the illustrated flood barrier section forms a flood barrier 3 against flooding water 4.

The flood barrier section 1 comprises an erectable wall 5 which along one of its edges 6, i.e. its lower edge, is hinged to a basis, which is formed by a support plate 13 which is located on the flooded side 10 of the wall 5. A hinge 7, which will be discussed later, enables a rotation of the wall 5 in the direction indicated by the arrow A, between a not illustrated essentially horizontal, collapsed storage position in which the wall 5 is located on top of the support plate 13, and the essentially vertical erected position which is illustrated in FIG. 1. The hinge 7 thus enables erecting the wall 5 from the storage position to the erected position when the flood barrier is to be used.

A flexible tie 8, formed by a rope, is in one end attached to an attachment 49 of the wall 5, and in the other end attached to an attachment 50 of a support bracket 48. The support bracket 48 is attached to the support plate 13 by a hinge 39, and is able to rotate into a collapsed position, as illustrated by the arrow B. The tie 8 extends from the support plate 13 to the wall 5 on the flooded side 10 of the wall 5, and prevents an erection of the wall 5 beyond the erected position in FIG. 1.

In use, when water 4 is present on the flooded side 10 of the wall 5, a potential problem is leakage of water underneath the flood barrier section 1, to the non-flooded side 11. To prevent this, the flood barrier section 1 is provided with a seal 12 which in the erected position of the flood section 1 is located between the flood barrier section and the ground 2. The flood barrier section 1 is adapted to, prior to flooding, to expose the seal 12 to a positive sealing pressure exceeding a pressure caused by the weight of the flood barrier section 1, i.e. the seal 12 is exposed to a sealing pressure which is larger than it would have been if the seal 12 was just placed underneath the flood barrier section 1, and the flood barrier section was resting on the seal 12.

In the embodiment in FIG. 1, ballast in the form of a sand bag 14 is located upon the support bracket 48, which ballast forces the support plate 13 downwards. The seal 12 is located under the support plate 13, close to an edge 54 of the support plate 13 which is distal to the wall 5. The weight of the wall 5 and the ballast 14 causes the support plate 13 to exert a downwardly directed levering action, which causes a positive sealing pressure on the seal 12. The weight of the water 4 above the support plate 13 also causes a downwardly directed pressure on the support plate 13, which causes a sealing pressure on the seal 12. An increasing water height, which will cause an increasing tendency to water leakage underneath the flood barrier section 1, also causes an increasing pressure on the support plate 13, which in turn causes an increasing sealing pressure on the seal 12.

A sheet of water-proof canvas 16, which is attached to the ground 2 by pegs 17 and squeezed between the support plate 13 and the support bracket 48, provides an additional sealing effect. The pegs 17 provide a temporarily attachment between the support plate 13 and the ground 2.

In the embodiment in FIG. 1, the hinge 7 is formed by a flexible sheet 15 which is attached to the wall 5 and the support plate 13. Preferably the flexible sheet 15 is waterproof and attached to the support plate 13 and the wall 5 by a suitable waterproof adhesive. This ensures a leak tight connection between the support plate 13 and the wall 5.

FIG. 2 illustrates a detail from FIG. 1, and it can be seen that the flexible sheet 15 is attached to the upper side of the support plate 13, i.e. the side of the support plate facing the water 4. Further the flexible sheet 15 is attached to the side of the wall 5 which faces away from the flooding water 4, i.e. the non-flooded side 11 of the wall 5. The water 4 exerts a pressure both on the support plate 13 and the wall 5, and this way of attaching the flexible sheet 15 ensures that, in the area of the hinge 7, the water pressure causes a positive pressure between the flexible sheet 15 and the support plate 13, and also between the flexible sheet 15 the wall 5. This way of attaching the flexible sheet 15 to the support plate 13 and the wall 5 thereby ensures that the connection between the support plate 13 and the wall 5 does not tear apart.

In a not illustrated embodiment, in which the support bracket 48 is not included, the ballast 14 can be placed directly on the support plate 13, and the seal 12 can be located under the support plate.

The flood barrier sections 1, 1', see FIG. 1, are mutually joined in the longitudinal direction of the flood barrier 3 by waterproof second seals 21. Such second seals may be formed by water-tight zip-fasteners or seal-lips which are attached to the flood barrier sections by velcroue.

FIG. 3 illustrates a second embodiment of a portable flood barrier section 1 according to the invention. Like the flood barrier section in FIG. 1, this flood barrier section also has a wall 5, a support plate 13 and a flexible sheet 15 which forms a hinge 7 between the wall and the support plate, and which provides a possibility for moving the wall as illustrated by the arrow A. Instead of the support bracket 48 in FIG. 1, this flood barrier section has a hinge bracket 23 which is attached to an edge 54 of the support plate which is distal to the wall 5 by means of bolts 25, and which forms an attachment for a flexible tie 8 which prevents the wall 5 from being erected beyond the erected position.

In the embodiment in FIG. 3, the support plate 13 is adapted to temporarily attachment to a permanent foundation 18 in the ground 2. This is achieved by the hinge bracket 23, which via a curved portion 24 is hinged to a hinge pin 22 of the foundation 18. The foundation 18 will have to be built prior to the flooding, in an area in which flooding is expected, and at a place in which it is suitable to erect the flood barrier. The seal 12 is located under the support plate 13, close to the edge 54 of the support plate 13 which is distal to the wall 5. The positive sealing pressure on the seal 12 is caused by a levering action due to the weight of the wall 5 and the hinge 22, 24 to the permanent foundation 18. The seal 12 is located on the foundation 18. The surface of the foundation 18 is fairly flat, which ensures a good sealing between the support plate 13 and the foundation. Thus there is no need for the water-proof canvas 16 which is illustrated in FIG. 1. During flooding, water (not illustrated) above the support plate 13 press the support plate down and creates an increased sealing pressure on the seal 12.

FIG. 4 illustrates a third embodiment of a portable flood barrier section 1 according to the invention. Like the flood barrier section in FIGS. 1 and 3, this flood barrier section also has a wall 5 and a support plate 13, which are hinged together by a hinge 7 which enables rotation of the wall 5 in the direction illustrated by arrow A. The hinge 7 consist of a flexible sheet 15 attached to the wall 5 on the flooded side 10 of the wall and the support plate 13 on the upper side. A right-angled support bracket 29 on the non-flooded side 11 of the wall 5 is attached to the support plate 13 and keeps the lower side of the wall 5 in place adjacent to the support plate 13. A rigid tie 9 connected to a snap fastener 31 on the wall 5 and a snap fastener 32 on the support plate 13, prevents the wall 5 from moving beyond the erected position, and at the same time holds the wall 5 in an erected position.

The support plate 13 is adapted to temporarily attachment to a permanent foundation 18 in the ground by means of a tension band 30. The tension band 30 is attached in one end to the snap fastener 32 on the support plate 13, at a position near an edge 54 of the support plate 13 distal to the wall 5.

The other end of the tension band 30 is attached to a pin 22 of the foundation 18. The tension band 30 may be flexible and/or adjustable, since this will give an easier installation of the flood barrier. The tension band 30 is favourable made of a material with little or no elasticity, but it may be elastic. As for the embodiment in FIG. 3, the foundation 18 will have to be built prior to the flooding, in an area in which flooding is expected, and at place in which it is suitable to erect a flood barrier.

In the embodiment in FIG. 4, the seal 12 is located under the support plate 13 distal to the wall 5. The positive sealing pressure is caused by a levering action due to the weight of the wall 5 and the support plate 13 and the tension in the tension band 30 connected to the foundation 18. Further, sealing pressure on the seal 12 is also provided by the weight of the water during flooding, which will press the support plate 13 down. The seal 12 is, as in the embodiment in FIG. 3 located on the foundation 18.

FIG. 5 illustrates a fourth embodiment of a portable flood barrier section 1 according to the invention. This embodiment does not have any support plate, instead the basis is formed by a permanent foundation 18 in the ground 2.

A hinge bracket 23 is attached to the wall 5 by bolts 25. A curved portion 24 of the hinge bracket 23 is hooked around a hinge pin 22 of the foundation 18, and it is thereby provided a hinge 7 between the wall 5 and the foundation 18, which enables a rotation of the wall 5 in the direction illustrated by the arrow A. A rigid tie rod 9 which via a hook 37 is attached to a tie rod bracket 38 of the wall 5, and via a hook 35 is hinged to a tie rod pin 36 of the foundation 18, prevents the wall 5 from being erected beyond the erected position.

As for the previous embodiments, reference numeral 10 indicates the flooded side of the wall 5, while reference numeral 11 indicates the non-flooded side.

The wall 5 is along a lower edge 6 provided with a projecting seal flange 19 which is formed by a side of an angle 33 which is attached to the wall 5. A flexible waterproof sheet 15 is attached to the wall 5 on the flooded side 10 and the underside of the seal flange 19. The seal 12 is located under the seal flange 19, and the positive sealing pressure is caused by a levering action C on the seal flange 19 due to a force from the tie rod 9. Additional sealing pressure is caused by the fact that water pressure from the flooding water tries to rotate the wall 5 beyond its erected position, which means that the wall 5 exerts a levering action in the direction C on the seal flange 19. This in turn causes the seal flange 19 to press the seal 12 down, which creates sealing between the seal flange 19 and the foundation 18.

FIG. 6 illustrates a foundation 18 to be used with the invention. This foundation is made in the ground 2 in an area in which flooding is expected, and in a location in which it is suitable to raise a flood barrier. On the left side 10 of the foundation 18, in which flooding can be expected, there is a grassy plain 44. On the right side, i.e. on the non-flooded side 11, there is an asphalt road 43. Thus the flood barrier will be erected along a road.

The foundation 18 is made from concrete, with reinforcing bars 40 made from steel. An upper reinforcing bar 40 is bent into a staggered shape, with portions 22 forming hinge pins in recesses 53 of the concrete. Thermal insulation 41 protects the foundation from frost damage. Further a waterproof subsurface membrane 20 extends from the permanent foundation 18 in the direction of the flooded area, i.e. in the direction of the grassy plain 44, in order to protect the foundation 18 from flooding water, and ensures that there is no water leakage underneath the foundation.

FIG. 7 illustrates another foundation to be used with the invention. This foundation consists of an angle 45 with a horizontal side 46 and a vertical, pointed side 47. This foundation can easily be placed in a soft ground 2, simply by pressing the pointed side 47 down into the ground by suitable means. In soft soil this may be done manually. The vertical side 47 prevents leakage underneath the flood barrier, and at the same time provides support for the horizontal side 46, which will form a sealing surface towards the seal of the flood barrier. By providing a number of foundation angles 45, 45' in a longitudinal direction, a foundation for a flood barrier can easily and quickly be made.

The seal 12 in all the different embodiments of the flood barrier sections and the flood barrier, can be of several types. The seal may be permanently or removable attached to the flood barrier sections or to the foundation. The seal can be attached to the flood barrier section by e.g. an adhesive or a tongue and groove connection, or the seal can also be placed loosely between the flood barrier section and the foundation or ground. The seal 12 may consist of a long, continuous seal that can be used for a number of flood barrier sections or a single seal for each flood barrier section. Another possibility is a first seal 12 covering more than one flood barrier section 1 and overlapping with a second seal 12 covering more than one second flood barrier section 1'.

The seal may be of different types and materials. One example is a seal of flexible rubber, and it can be hollow, to ensure a good flexibility and adaptation to an uneven ground. A seal 12 that is adaptable to an uneven ground is especially important for the embodiment shown in FIG. 1, where the flood barrier sections are placed on the ground and not on an even foundation. The seal 12 can be inflatable, by for instance a gas like air or even water. The seal 12 may be made of or partly consist of materials that swell in contact with water, so that it will tend to swell into gaps for example in an uneven ground. In a seal that consist of only a swelling material, the swelling material would also have to prevent flood water from coming through the seal. A seal that partly consist of swelling material may be formed with a watertight material on three of its sides, top, bottom and the side faced the non-flooded side of the flood barrier section and a material within that swells in contact with water. Since the watertight material only cover three sides, the swelling material will come in contact with the water and swell and by that, force the watertight material against the flood barrier section and the ground or the foundation and provide a tight seal.

The wall and the support plate can be made from various materials, e.g. waterproof plywood or another laminate.

The invention claimed is:

1. A portable flood barrier section (1) to be located on a ground (2) to form a barrier (3) against flooding water (4), comprising an erectable wall (5) which along one of its edges (6) is hinged to a basis, the hinge (7) enabling a rotating erection (A) of the wall (5) from an essentially horizontal position to an erected position, a flexible or rigid tie (8, 9) which extends from the basis to the wall (5) on the flooded side (10) of the wall (5), to prevent an erection of the wall (5) beyond the erected position, and a seal (12) which in the erected position of the flood barrier section (1) is located between the flood barrier section and the ground (2), and that the flood barrier section (1) is adapted to, prior to flooding, expose the seal (12) to a positive sealing pressure exceeding a pressure caused by the weight of the flood barrier section (1), wherein the basis is formed by a support plate (13) located on the flooded side (10) of the wall (5), an edge (54) of the support plate distal to the wall (5) is hinged (22, 23, 24, 30) to a permanent foundation (18) in the ground, and the seal (12) is located under the support plate (13), close to the edge (54) of the support plate (13) which is distal to the wall (5), the positive sealing pressure on the seal (12) being caused by a levering action due to the weight of the wall (5) and the hinge (22, 24, 30) to the permanent foundation (18).

2. A portable flood barrier section (1) according to claim 1, wherein the hinge (22,30) between the support plate (13) and the foundation (18), is formed by a tension band (30) attached to the upper side of the support plate (13) and a hinge pin (22) in the foundation (18).

3. A portable flood barrier section (1) according to either of the claims 1 or 2, wherein the hinge (7) is formed by a flexible sheet (15) which is attached to the upper side of the support plate (13) and the side of the wall (5) facing away from the flooding water (4).

4. A portable flood barrier section (1) according to claim 3, wherein a waterproof subsurface membrane (20) extends from the permanent foundation (18) in the direction of the flooded area.

5. A portable flood barrier section (1) according to claim 4, wherein the seal (12) comprises a material that swells in contact with water.

6. A portable flood barrier section (1) according to claim 4, wherein the seal (12) is inflatable.

7. A flood barrier (3) comprising flood barrier sections (1) according to claim 4, the flood barrier sections (1) being mutually joined in the longitudinal direction of the flood barrier (3) by waterproof second seals (21).

8. A portable flood barrier section (1) according to claim 3, wherein the seal (12) comprises a material that swells in contact with water.

9. A portable flood barrier section (1) according to claim 3, wherein the seal (12) is inflatable.

10. A flood barrier (3) comprising flood barrier sections (1) according to claim 3, the flood barrier sections (1) being mutually joined in the longitudinal direction of the flood barrier (3) by waterproof second seals (21).

11. A portable flood barrier section (1) according to either of claims 1 or 2, wherein a waterproof subsurface membrane (20) extends from the permanent foundation (18) in the direction of the flooded area.

12. A portable flood barrier section (1) according to claim 11, wherein the seal (12) comprises a material that swells in contact with water.

13. A portable flood barrier section (1) according to claim 11, wherein the seal (12) is inflatable.

14. A flood barrier (3) comprising flood barrier sections (1) according to claim 11, the flood barrier sections (1) being mutually joined in the longitudinal direction of the flood barrier (3) by waterproof second seals (21).

* * * * *